US011332275B2

(12) United States Patent
Wu

(10) Patent No.: US 11,332,275 B2
(45) Date of Patent: May 17, 2022

(54) HONEYCOMB STRUCTURE

(71) Applicant: PEGATRON CORPORATION, Taipei (TW)

(72) Inventor: Fang-Yi Wu, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 153 days.

(21) Appl. No.: 16/790,039

(22) Filed: Feb. 13, 2020

(65) Prior Publication Data

US 2020/0262603 A1 Aug. 20, 2020

(30) Foreign Application Priority Data

Feb. 14, 2019 (TW) ..... 108104973

(51) Int. Cl.
*B65D 5/49* (2006.01)

(52) U.S. Cl.
CPC ..... *B65D 5/48038* (2013.01)

(58) Field of Classification Search
CPC ..... B65D 25/06; B65D 2571/00913; B65D 5/0005; B65D 5/48036; B65D 5/48038; B65D 5/48042
USPC ..... 229/120.27, 120.28
See application file for complete search history.

(56) References Cited

U.S. PATENT DOCUMENTS

| | | | | | |
|---|---|---|---|---|---|
| 312,421 | A | | 2/1885 | Bauer | |
| 1,984,609 | A | * | 12/1934 | Walker | B65D 5/48032 229/120.03 |
| 4,095,735 | A | * | 6/1978 | Stone | B65D 5/48004 206/782 |
| 4,875,585 | A | * | 10/1989 | Kadleck | B65D 71/18 206/426 |
| 2017/0089378 | A1 | | 3/2017 | Dissen et al. | |

FOREIGN PATENT DOCUMENTS

| | | | | | |
|---|---|---|---|---|---|
| CN | 106608400 | A | | 5/2017 | |
| GB | 502126 | A | * | 3/1939 | B65D 5/48038 |
| KR | 20100082467 | A | * | 7/2010 | |

* cited by examiner

*Primary Examiner* — Mollie Impink
(74) *Attorney, Agent, or Firm* — Muncy, Geissler, Olds & Lowe, P.C.

(57) ABSTRACT

A honeycomb structure is disclosed. The honeycomb structure includes a plurality of first partitions and a plurality of second partitions. The plurality of first partitions has a plurality of first honeycomb partitions. The plurality of second partitions has a plurality of second honeycomb partitions, and the plurality of first honeycomb partitions and the plurality of second honeycomb partitions are fitted to each other such that the plurality of second partitions and the plurality of first partitions are interdigitated to form at least one receiving portion, wherein the plurality of Its first honeycomb partitions have at least one die line. One part of at least one first honeycomb partition is bendable at least one die line to change the size of an opening size of the receiving portion corresponding to the at least one first honeycomb partition which is bended.

8 Claims, 4 Drawing Sheets

HONEYCOMB STRUCTURE

BACKGROUND DISCLOSURE

1. Technology Field

The present disclosure relates to a honeycomb structure; more particularly, the present disclosure relates to a honeycomb structure capable of changing the size of its receiving portion.

2. Description of the Related Art

In order to pack multiple relatively smaller sized components, conventionally, honeycomb shaped partitions would be disposed within a box, so that the components can be placed in the partitioned compartments. However, in the prior art, the size of the compartments partitioned by the honeycomb shaped partitions is fixed, which is suitable for placing components of one size. If there is a need of placing components of different sizes at the same time, additional buffer materials would be used to fill in extra space for smaller sized components to prevent the components from moving. As a result, the packaging cost would be increased accordingly.

Therefore, there is a need to provide a honeycomb structure to mitigate and/or obviate the aforementioned problems.

SUMMARY OF THE DISCLOSURE

It is an object of the present disclosure to provide a honeycomb structure, which is capable of changing the size of its receiving portion.

To achieve the abovementioned object, the honeycomb structure of the present disclosure comprises a plurality of first partitions and a plurality of second partitions. The plurality of first partitions has a plurality of first honeycomb partitions. The plurality of second partitions has a plurality of second honeycomb partitions. The plurality of first honeycomb partitions and the plurality of second honeycomb partitions are fitted to each other, such that the plurality of second partitions and the plurality of first partitions are interdigitated to form a plurality of receiving portions, wherein at least one first honeycomb partition has at least one die line. One part of the at least one first honeycomb partition is bendable along the at least one die line, so as to change the size of an opening of the receiving portion corresponding to the at least one first honeycomb partition which is bended.

Other objects, advantages, and novel features of the disclosure will become more apparent from the following detailed description when taken in conjunction with the accompanying drawings.

BRIEF DESCRIPTION OF THE DRAWINGS

These and other objects and advantages of the present invention will become apparent from the following description of the accompanying drawings, which disclose several embodiments of the present invention. It is to be understood that the drawings are to be used for purposes of illustration only, and not as a definition of the invention.

In the drawings, wherein similar reference numerals denote similar elements throughout the several views.

DETAILED DESCRIPTION OF THE PREFERRED EMBODIMENT

Figure 1:
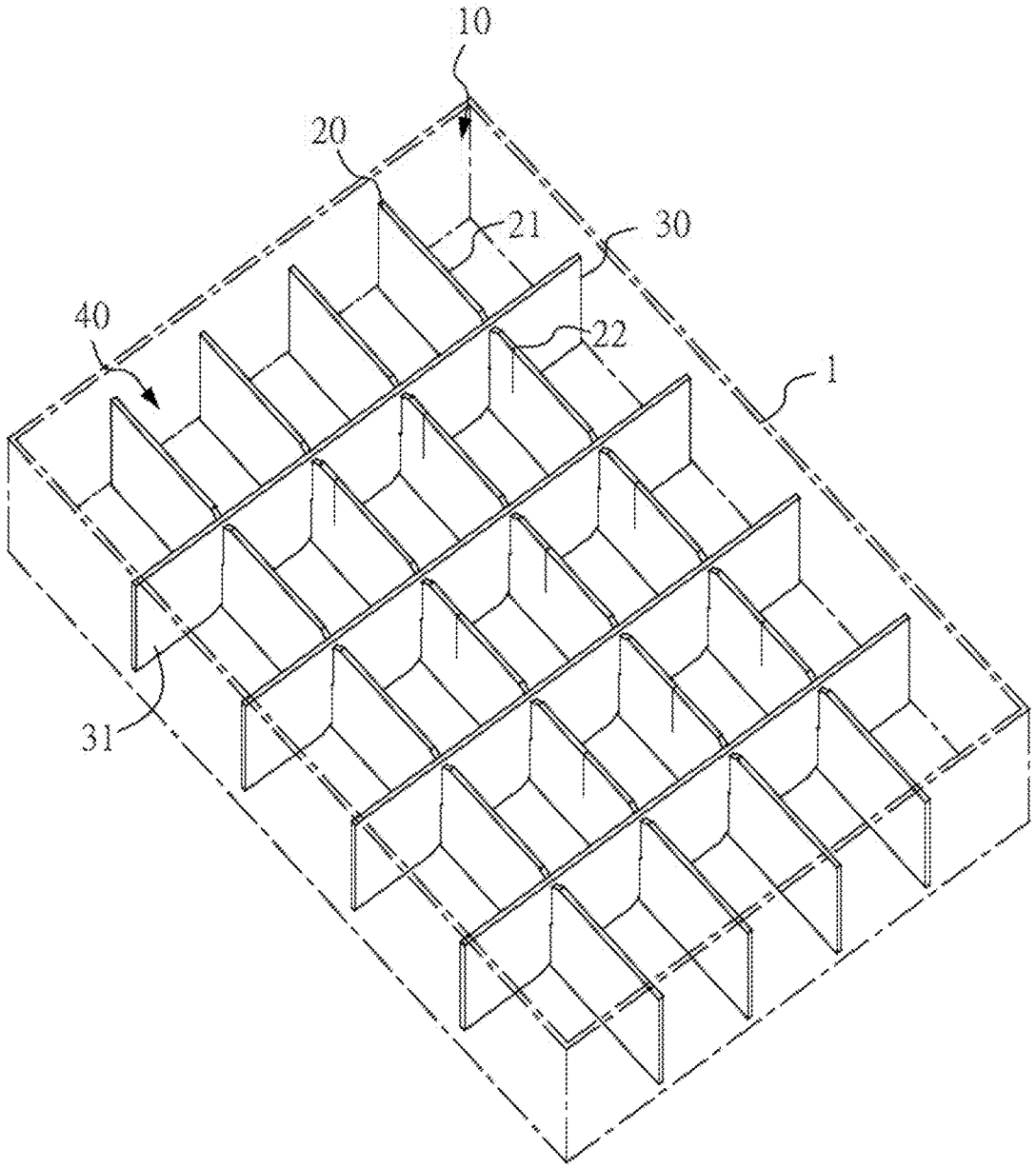
FIG. 1 illustrates a schematic drawing of a honeycomb structure being placed within a box of the present invention.

Please refer to FIG. 1, which illustrates a schematic drawing of a honeycomb structure being placed within a box of the present invention. Please note that despite the terms of "first" and "second" are used to describe components in the embodiments, these components shall not be limited to such terms. These terms are merely used for distinguishing one component from another. For example, without departing from the scope of each embodiment disclosed herein, the first partition can be named as the second partition; likewise, the second partition can be named as the first partition. The first partition and the second partition are both partitions, but they are not referring to the same partition.

Figure 2:
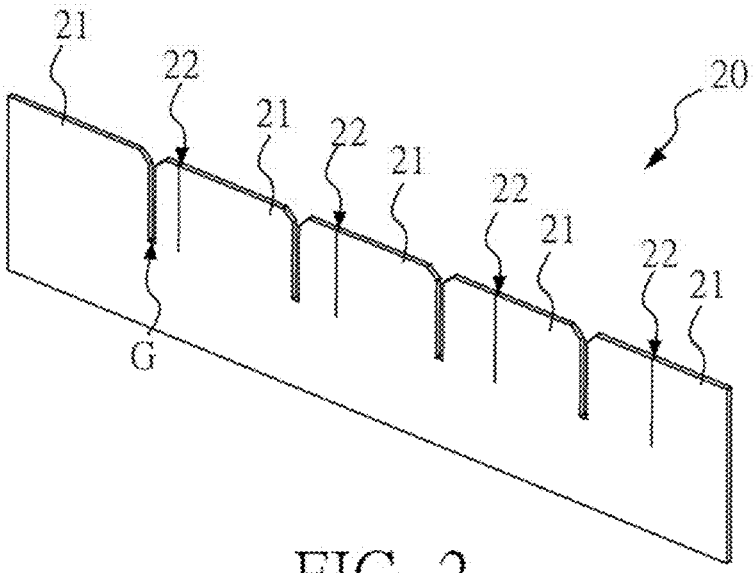
FIG. 2 illustrates a schematic drawing of a first partition of the honeycomb structure of a first embodiment of the present invention.

The honeycomb structure 10 comprises a plurality of first partitions 20 and a plurality of second partitions 30, which are made of cardboard. Please note that the term "honeycomb structure" refers to the collective name of the inner partition, and does not define the material or structure. Each of the first partitions 20 has a plurality of first honeycomb partitions 21, and each of the second partitions 30 has a plurality of second honeycomb partitions 31. A gap G is provided between each two adjacent honeycomb partitions (as shown in FIG. 2). Each of the first honeycomb partitions 21 and each of the second honeycomb partitions 31 are fitted to each other via the gap G, such that the plurality of second partitions 30 and the plurality of first partitions 20 are interdigitated to form a plurality of receiving portions 40. Then, the honeycomb structure 10 would be placed within a box 1. As a result, the receiving portions 40 can be utilized to place items (not shown in figures).

Figure 3:
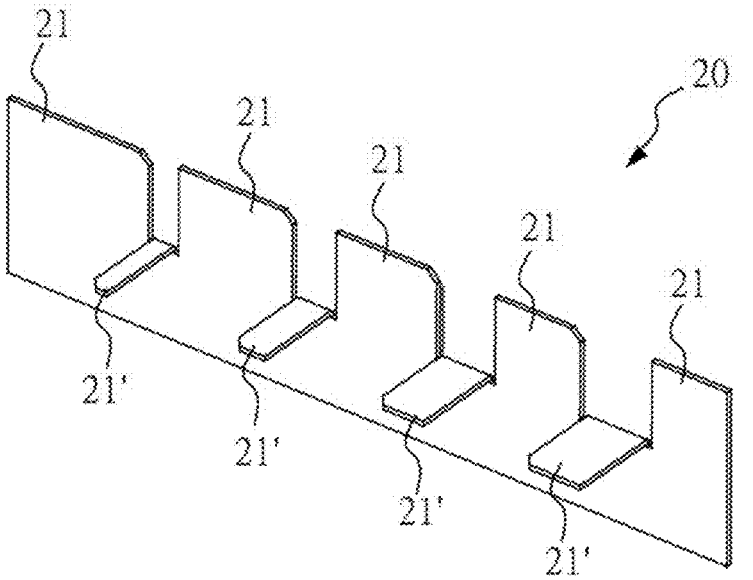
FIG. 3 illustrates a schematic drawing showing one part of the first partition of the honeycomb structure being bent of the present invention.

At least one first honeycomb partition 21 has at least one die line 22, as shown in FIG. 2. Please refer to both FIG. 2 and FIG. 3, wherein FIG. 2 illustrates a schematic drawing of the first partition of the honeycomb structure of a first embodiment of the present invention, and FIG. 3 illustrates a schematic drawing showing one part of the first partition of the honeycomb structure being bent of the present invention.

Figure 4A:
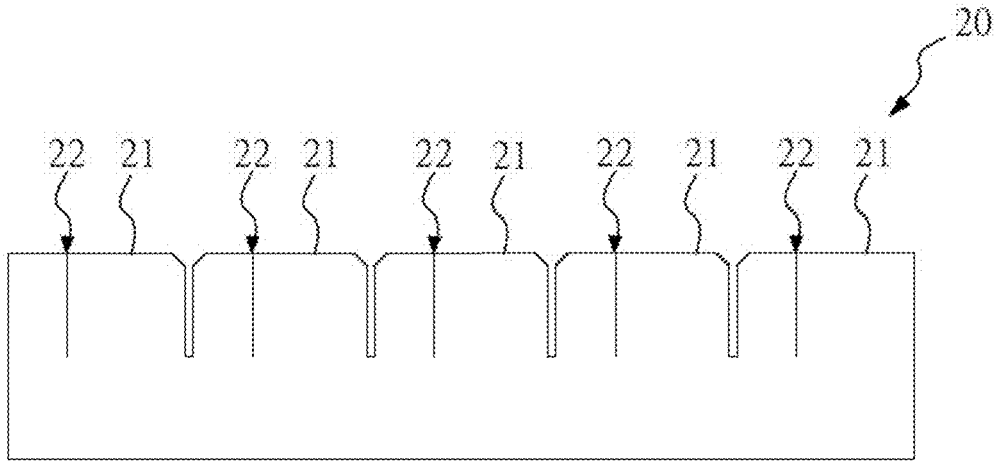
FIG. 4A illustrates a schematic drawing of the first partition of the honeycomb structure of a second embodiment of the present invention.
Figure 4B:
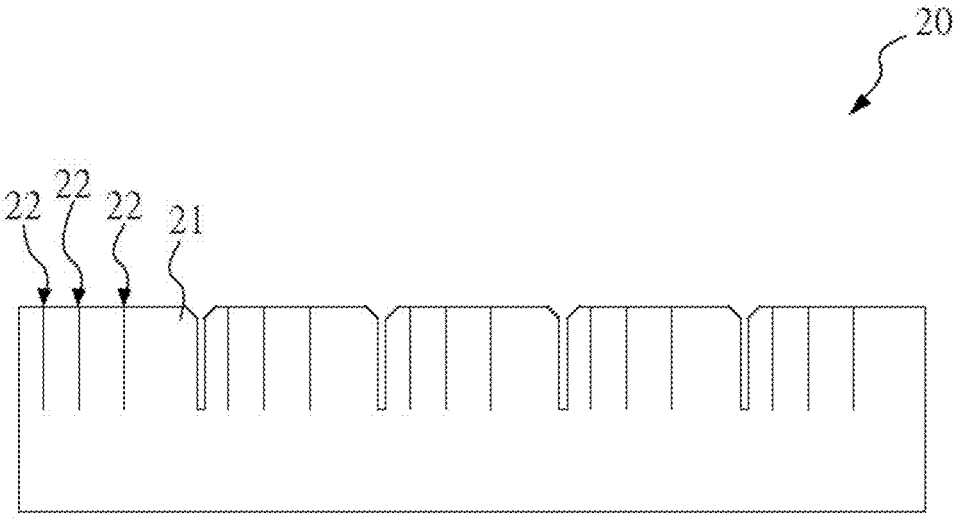
FIG. 4B illustrates a schematic drawing of the first partition of the honeycomb structure of a third embodiment of the present invention.

In the first embodiment of the present invention, each of the first honeycomb partitions 21 of the first partitions 20 has at least one die line 22. The die line 22 is a line formed on the first honeycomb partition 21 cut through by knife. As a result, one part of the first honeycomb partition 21' can be bent along a line perpendicular to the die line 22. In the first embodiment of the present invention, the die lines 22 provided at different first honeycomb partitions 21 are cut at different positions, such that the one parts of different first honeycomb partitions 21' would have different widths. However, the scope of the present invention is not limited to the above description. As shown in FIG. 4A, in a second embodiment of the present invention, the die lines 22 provided at different first honeycomb partitions 21 can be cut at the same position; therefore the one parts of different first honeycomb partitions 21' would have the same width. Or, as shown in FIG. 4B, in a third embodiment of the present invention, the first honeycomb partition 21 may have a plurality of die lines 22, such that the width of the bent part may vary according to different needs.

Figure 5:
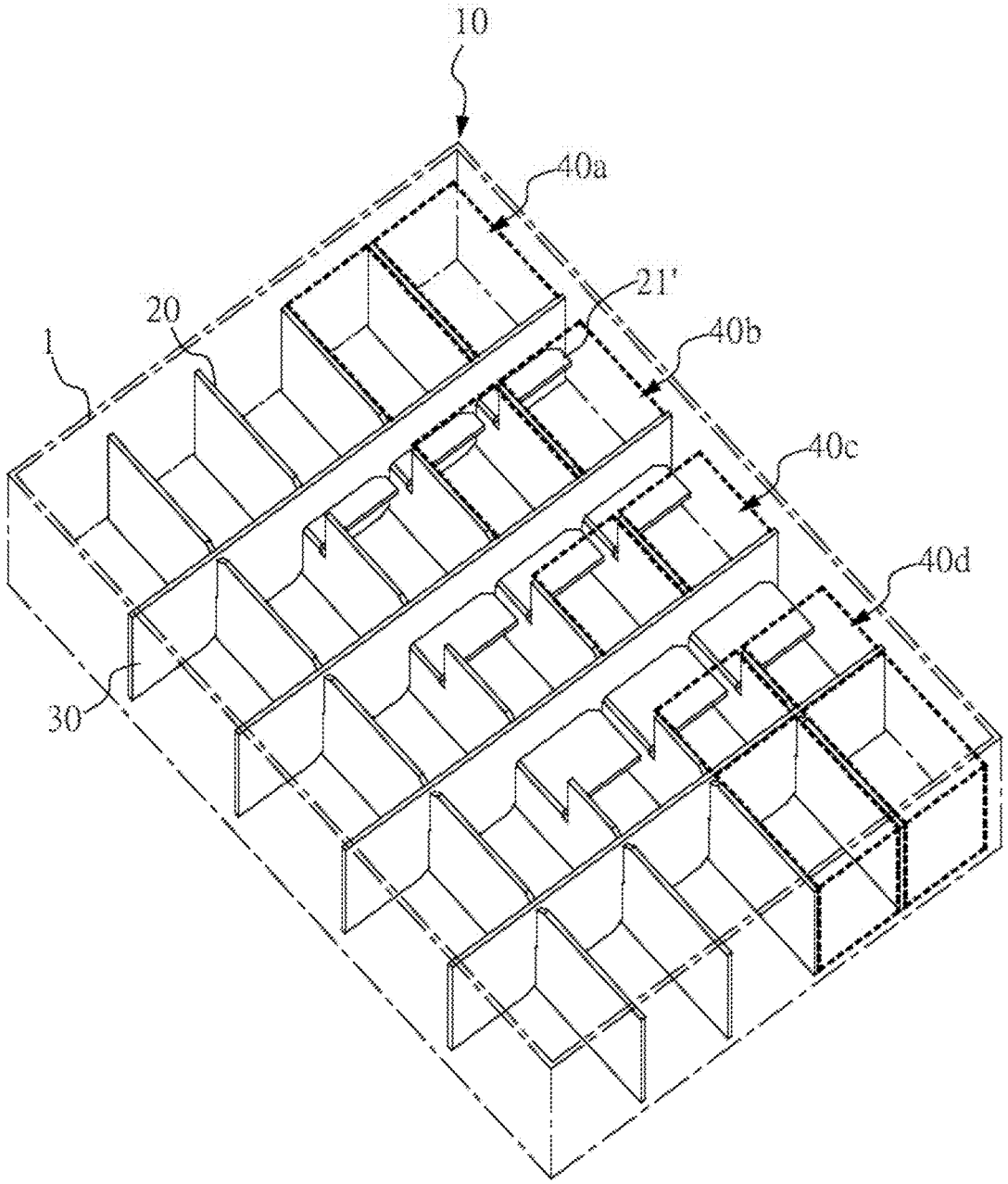
FIG. 5 illustrates a schematic drawing showing one part of the first partition of the honeycomb structure being bent and placed within the box of the present invention.

Last, please refer to FIG. 5, which illustrates a schematic drawing showing one part of the first partition of the honeycomb structure being bent and placed within the box of the present invention.

Therefore, after the plurality of first partitions 20 and the plurality of second partitions 30 form the plurality of receiving portions 40, one part of the plurality of first honeycomb partitions 21' is bent along the line perpendicular to the at least one die line 22, so as to change the size of an opening of the receiving portion 40 corresponding to the at least one first honeycomb partition 21. That is, the receiving portions 40*a* to 40*d* of different sizes can be formed to accommodate different needs. Please note that the cutting length of the die line 22 can be slightly longer than the width of the second honeycomb partition 31, such that the bent part of the first honeycomb partition 21' can contact against another first partition 20 to form the plurality of receiving portions 40.

As a result, the honeycomb structure 10 of the present invention can change the size of the receiving portion 40 to accommodate different needs, thereby effectively reducing costs.

It should be noted that the preferred embodiments of the present invention described above are only illustrative. To avoid redundancy, all the possible combinations of changes are not documented in detail. However, it shall be understood by those skilled in the art that each of the modules or elements described above may not be necessary. For the implementation of the present invention, the present invention may also contain other detailed, conventional modules or elements. Each module or component is likely to be omitted or modified depending on the needs. Other modules or elements may not necessarily exist between two of any modules. All without departing from the scope of the invention are defined solely by the appended claims.

What is claimed is:

1. A honeycomb structure, comprising:

a plurality of first partitions, wherein each of the first partitions has a plurality of first honeycomb partitions; and a plurality of second partitions, wherein each of the second partitions has a plurality of second honeycomb partitions, wherein each of the first honeycomb partitions and each of the second honeycomb partitions are fitted to each other, such that the plurality of second partitions and the plurality of first partitions are interdigitated to form a plurality of receiving portions, wherein at least one first honeycomb partition has at least one die line, wherein the at least one die line is formed by cutting through one part of the at least one first honeycomb partition, such that one part of the at least one first honeycomb partition is bendable along a line perpendicular to the at least one die line, so as to change the size of an opening of the receiving portion corresponding to the at least one first honeycomb partition which is bent, wherein a cutting length of the at least one die line is slightly longer than a width of the second honey comb partition.

2. The honeycomb structure as claimed in claim 1, wherein the honeycomb structure is placed within a box.

3. The honeycomb structure as claimed in claim 1, wherein each of the first honeycomb partitions has a plurality of die lines.

4. The honeycomb structure as claimed in claim 3, wherein the honeycomb structure is placed within a box.

5. The honeycomb structure as claimed in claim 1, wherein a plurality of gaps are formed on each of the second partitions, so as to divide each of the second partitions into the plurality of second honeycomb partitions.

6. The honeycomb structure as claimed in claim 5, wherein the honeycomb structure is placed within a box.

7. The honeycomb structure as claimed in claim 1, wherein the plurality of first partitions and the plurality of second partitions are cardboard.

8. The honeycomb structure as claimed in claim 7, wherein the honeycomb structure is placed within a box.

* * * * *